US006359540B1

(12) United States Patent
Spiller et al.

(10) Patent No.: US 6,359,540 B1
(45) Date of Patent: Mar. 19, 2002

(54) SUPERCONDUCTING LEADS

(76) Inventors: Darren Michael Spiller, 49 Alwyn Gardens, Upton, Chester, Cheshire CH2 1LW; Michael Patrick Webb, 56 Kingfisher Way, Marchwood, Southampton SO40 4XS; Carlos Beduz, 19 Kitchener Road; Yifeng Yang, 5 Kitchener Road, both of Portswood Southampton SO17 3SF, all of (GB)

( * ) Notice: Subject to any disclaimer, the term of this patent is extended or adjusted under 35 U.S.C. 154(b) by 0 days.

(21) Appl. No.: 09/786,678

(22) PCT Filed: Sep. 9, 1999

(86) PCT No.: PCT/US99/20526

§ 371 Date: Jun. 18, 2001

§ 102(e) Date: Jun. 18, 2001

(87) PCT Pub. No.: WO00/14827

PCT Pub. Date: Mar. 16, 2000

(30) Foreign Application Priority Data

Sep. 9, 1998 (GB) ..... 9819545

(51) Int. Cl.[7] ..... H01F 6/06

(52) U.S. Cl. ..... 335/216; 505/220; 505/706

(58) Field of Search ..... 335/216; 174/15.4, 174/15.5, 125.1; 505/220, 706, 879, 884–887

(56) References Cited

U.S. PATENT DOCUMENTS 6,034,324 A * 3/2000 Dixon et al. ..... 174/15.4

* cited by examiner

*Primary Examiner*—Ramon M. Barrera
(74) *Attorney, Agent, or Firm*—Finnegan, Henderson, Farabow, Garrett & Dunner, L.L.P.

(57) ABSTRACT

A superconducting lead comprises a supporting board (1) with at least one superconducting tape (3) adhered to it and extending from one terminal area of the lead to another. Respective metal end-fittings soldered to the superconducting tape (3) at each of its ends, and in each of the terminal areas at least one metal insert is bonded to the board (1) and also soldered to the corresponding one of the said end-fittings, so relieving the tapes (3) of mechanical stress. The board (1), or each of them, is preferably flat and may support two or more superconducting tapes (3) coplanar with one another on one or on each of its major faces. The metal inserts are preferably of copper and may be made by removing most of the copper cladding from a commercially available circuit board (1).

11 Claims, 1 Drawing Sheet

SUPERCONDUCTING LEADS

§ 371 of International Application No. PCT/US99/20526, filed Sep. 9, 1999, which claims the priority of Great Britain Application No. 9819545.6, filed Sep. 9, 1998.

This invention relates to superconducting leads, primarily for use as "current leads", meaning (as customary among superconductivity experts) leads for conveying current to a apparatus operating at a cryogenic temperature from a source at a substantially higher temperature. In most applications the cryogenic temperature will be a "liquid helium" temperature in the vicinity of 4 K and the higher temperature will be liquid nitrogen temperature (around 77 K) or lower.

Superconducting current leads are preferred, when the level of the higher temperature makes it possible, both because their own losses electrical are smaller than for comparable metal current leads and also because they can have substantially higher thermal resistance and offer appreciably reduce overall refrigeration losses of the apparatus.

Superconducting current leads have been made with "bulk" ceramic superconductor powder, either compressed and sintered into self-supporting blocks or packed into a silver (or silver alloy) tube and suitably compressed. They have also been made with ceramic superconductors in tape form, as they would now normally be used for winding coils or making power cables. However, "bulk" superconductor leads are brittle, mechanically weak, and are liable to be destroyed if fault conditions lead to loss of superconductivity; superconducting tapes are self-protecting from such faults as the silver/silver alloy content is sufficient to carry the current as a normal conductor for short periods and they are flexible and somewhat more resistant to thermal cycling shock, but they still have little inherent strength, and as the thermal stresses are necessarily rather large in a current lead operating with its ends at very different temperatures and subject at least occasionally to cycles to room temperature, they need mechanical support.

One satisfactory way of giving mechanical support is to bond the tapes with a suitable adhesive to support (this may be of various cross-sections but our own preference is that it should be flat and for convenience we refer to it as a "board") of a resin-bonded fibre glass or other material having thermal expansion characteristics reasonably similar to those of the tape. Even then, substantial stresses arise at the terminations, where the tapes will normally be connected to a solid copper conductor by soldering, and it is the applicants' experience that this may result in partial or complete failure of the soldered connection and that, even under favourable conditions, the contact resistance at the two terminations may account for as much as a fifth of the total losses in the current lead.

It is an object of the invention to provide a superconducting lead suitable for use as a current lead in which the terminations are secure and the terminal contact resistance stabilised at a low value.

The superconducting lead in accordance with the invention comprises a supporting boards, at least one superconducting tape adhered to the supporting boards, a terminal member forming a metal end-fitting soldered to the superconducting tape at an end of the supporting board and at least one metal insert bonded to the supporting board and soldered to the metal end-fitting.

In this way, longitudinal mechanical stresses can be carried from the end-fittings directly to the board, bypassing and so relieving of stress the soldered joints to the tape.

There may be more than one board, and the board, or each board as the case may be, may support any convenient number of superconducting tapes. Preferably the board, or each of them, is flat and supports two or more tapes coplanar with one another on one or on each of its major faces, so that the whole flat side and both edges of each tape are accessible for soldering without requiring a complex shape for the terminal member. However, two or three tapes (or more, at an increasing penalty) can be superposed on one another if compactness is of over-riding importance.

The metal inserts, as well as the terminal members, are preferably of copper, especially high-conductivity "oxygen-free" copper, (and the terminal members preferably plated with gold or silver). They are conveniently simple rectangular strips along (or parallel and close to) the appropriate edges of the board. Strips only a few millimetres wide are effective and considered adequate, but if desired they could be wide enough to facilitate reinforcement by drilling to accomodate a transverse pin of metal or other hard material.

Suitable boards with copper very strongly bonded over substantially its whole area is readily available as it is widely used to make circuit boards for electronics applications. One suitable board is a resin-bonded fibreglass board clad with about 35 $\mu$m of copper and coated with a positive working photoresist to comply with BS 4581, sold under the trademark "Fotoboard" and grade code "FR4" by Mega Electronics. Copper can be removed, except for the required inserts, by imagewise exposure to UV light, development and etching (for which the board is designed) or by machining. It is the applicants' understanding that this board is made by in-situ curing of the fibre-bonding resin on a pre-formed and specially prepared (etched) copper sheet.

Preferably the (or each) superconducting tape is bonded to the board over the whole area of the tape. A suitable adhesive is manufactured by Grace Specialty Polymers and sold in the United Kingdom by Emerson Cumming (UK) Ltd under the trademark "Eccobond 286" and is understood to be an epoxy resin product filled with an oxide of aluminium or of zirconium to improve matching of thermal expansion characteristics.

The lead may incorporate two or more boards with superconducting tapes as described, preferably but not necessarily arranged parallel to one another; they may be alike (typically resulting in a rectangular cross-section) or may differ in width (with or without the number of tapes differing), for example to give an overall round cross-section.

Silver/silver alloy clad ceramic superconductor tapes can be successfully soldered to the terminal members by a suitable solder; we prefer solders comprising (by weight) equal parts of lead and bismuth or 2 parts of lead, 5 parts of bismuth and 3 parts of tin, but ordinary tin/lead eutectic solder can be used.

If it is desired that the lead should be "vapour-cooled", the superconducting tape(s) is/are preferably coated to protect from contact with coolant; Nova Tran Ltd offer a custom coating a thickness of about 30–40 $\mu$m is recommended; but other coatings can be used. The applicants do not know whether the process operated by Nova Tran Ltd (described as a gas phase deposition) resembles the technique using pyrolysed poly-para-xylylene described in U.S. Pat. No. 4,508,760. In most such cases a tubular shroud with appropriate apertures for vapour flow will be added after coating.

If "vapour-cooling" is not desired, then we prefer to protect the lead by adding a closely-fitting enclosure and "potting" by introduction of a suitable hardening resin (such as Eccobond 286 referred to above) into the remaining clearances. Such enclosure is suitable made from a resin-bonded fibre glass material similar to the material of the board or boards; a suitable material is sold by Tufnol Ltd under their trademark TUFNOL and the product code 10 G/40.

The terminal members may project axially for external connection, but where the installation geometry permits we prefer that they project laterally, so as to accomodate the maximum length of superconductor, and thus minimise thermal conductance of the lead.

The invention will be further described, by way of example, with reference to the accompanying drawing in which.

Figure 1:
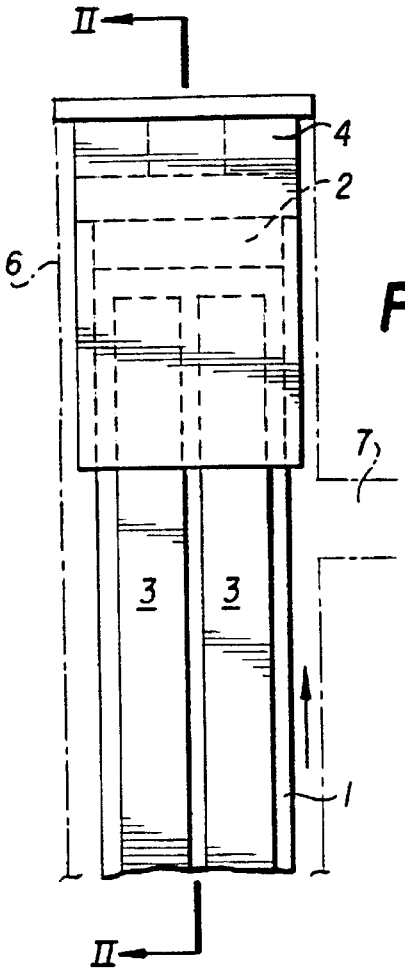
FIG. 1 is a partly diagrammatic elevation of an end part of one form of lead in accordance with the invention.
Figure 2:
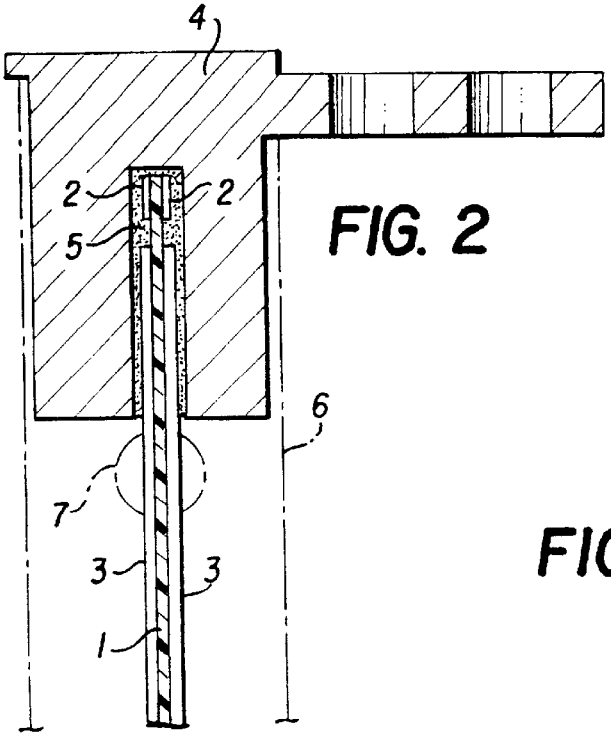
FIG. 2 is a cross-section on the line II—II in FIG. 1.

The lead of FIGS. 1 and 2 is based on a narrow strip of double-sided FOTOBOARD circuit board 1 with the copper layers entirely etched away except for narrow strips 2, at each end (only one end is shown, the other may be identical). On each of the so exposed faces of the board superconducting tapes 3 each consisting of one or more "filament" of a "high temperature" ceramic superconducting material (preferably of the BISCCO family) are adhered using Eccobond 286 low-expansion epoxy adhesive. The end of the board is inserted in a slot in a gold-plated copper terminal member 4 and bonded to it by a solder 5 consisting of equal parts by weight of lead and bismuth. The solder bonds securely both to the tapes 3 (providing a low-resistance electrical connection) and to the copper strips 2 (providing a strong mechanical connection from the board 1 to the terminal member 4 which is wholly independent of the tapes 3).

In the case of a vapour-cooled lead, the exposed surfaces of the tapes (and optionally those of the boards as well) are thinly coated with the PARYLENE polymer coating identified above and the board enclosed by a plastics shroud 6 provided with openings 7 for the flow of coolant.

Note that in this design, the terminal member 4 extends to the side of the lead proper—it is a "flag" rather than a "spade" type terminal. This permits the superconducting, and relatively thermally insulating, part of the lead to be as long as the nature of the installation permits.

Figure 3:
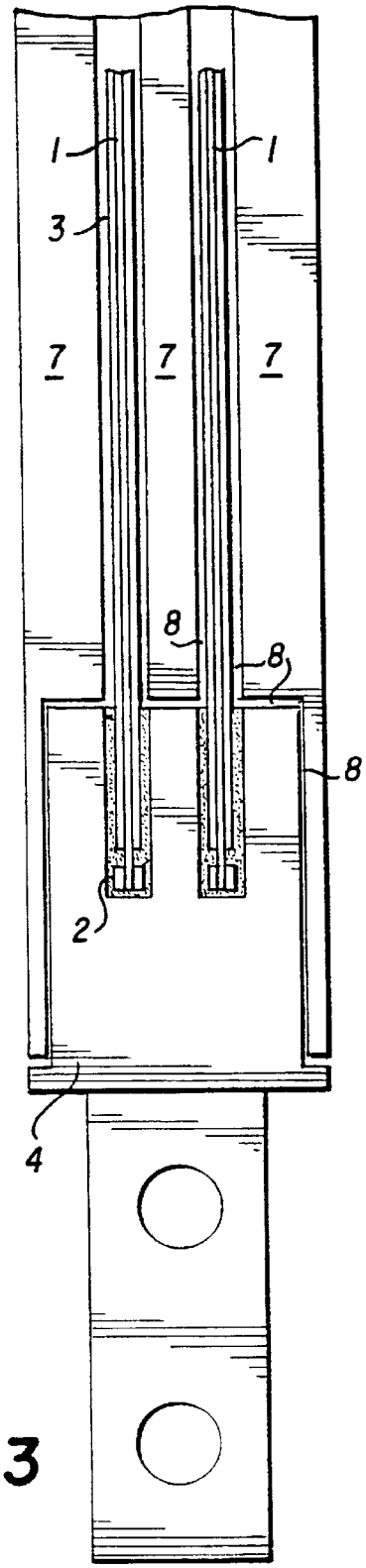
FIG. 3 is an elevation, corresponding to FIG. 1, showing an alternative form of lead in accordance with the invention and incorporating a number of independent options; this figure shows the lead in an unfurnished condition, as will be explained below.

The alternative design shown in FIG. 3 illustrates a number of variants, any of which may be used separately as well as together.

First, it is a "spade" type terminal with the axes of the lead and the terminal member coincident, and so it is suitable for direct substitution for a conventional current lead of similar shape.

Second, it comprises two similar boards 1 for increased supercurrent capacity. Higher numbers can be used, and different widths of board with the same or different numbers of tapes can be used to meet design requirements: for example, three parallel boards with the central one wider than the others allows an approximation to circular cross-section, when desired.

Third, it is not intended for use with vapour cooling. Consequently, instead of coating the tapes and adding an open tubular housing, the assembly is completed by a jacket made up of two components of resin-bonded fibreglass (TUFNOL 10 G/40) machined to fit around the boards and terminal members with only a small clearance. FIG. 3 shows one of these jacket components 9 in place and omits the other for clarity. Once both components are in place, the remaining clearances 8 are filled with an epoxy resin by a vacuum impregation technique to form a fully potted lead.

What is claimed is:

1. A superconducting lead comprising a supporting board, at least one superconducting tape adhered to the supporting board, a terminal member forming a metal end-fitting soldered to the superconducting tape at each end of the supporting board and at least one metal insert bonded to the supporting board and soldered to the corresponding one of the said metal end-fittings.

2. A superconducting lead comprising two terminal members, a supporting board extending between the terminal members, at least one superconducting tape adhered to the supporting board, wherein each terminal member forms a metal end-fitting soldered to the superconducting tape at respective ends of the supporting board and at each end of the supporting board a metal insert bonded to the supporting board and soldered to the corresponding one of the said metal end-fittings.

3. A superconducting lead as claimed in claim 1 or claim 2, wherein the board is flat and supports two or more superconducting tapes coplanar with one another on one or on each major face of the board.

4. A superconducting lead as claimed in claim 1 or claim 2, wherein the metal inserts and the terminal members are copper.

5. A superconducting lead as claimed in claim 1 or claim 2, wherein the metal inserts and the terminal members, are of high conductivity oxygen-free copper.

6. A superconducting lead as claimed in claim 1 or claim 2, wherein the metal inserts are rectangular strips along an edge of the board.

7. A superconducting lead as claimed in claim 1 or claim 2, further comprising two or more said boards which differ in width, with or without the number of tapes differing.

8. A superconducting lead as claimed in claim 1 or claim 2, wherein each superconducting tape is coated to protect said tape from contact with coolant.

9. A superconducting lead as claimed in claim 8 further comprising a tubular shroud with apertures for vapour flow.

10. A superconducting lead as claimed in claim 1 or claim 2, further comprising a closely fitting enclosure and potting resin in remaining clearances.

11. A superconducting lead as claimed in claim 1 or claim 2, wherein the terminal members project laterally.

* * * * *